United States Patent [19]

Scott, Jr. et al.

[11] 4,000,895

[45] Jan. 4, 1977

[54] BALL BAT

[75] Inventors: Irvin C. Scott, Jr.; George F. Swenck, both of Richmond, Va.

[73] Assignee: Reynolds Metals Company, Richmond, Va.

[22] Filed: Aug. 18, 1975

[21] Appl. No.: 605,660

[52] U.S. Cl. ..... 273/72 A

[51] Int. Cl.[2] ..... A63B 59/06

[58] Field of Search ..... 273/67 A, 67 DA, 68, 273/70, 72 R, 72 A, 73 J, 75, 81 R, 81.5, 80.2–80.5; 43/23; 145/61 R; 74/551.8, 551.9, 558, 558.5; 403/379; 85/8.3; 16/121

[56] References Cited

UNITED STATES PATENTS

| | | | |
|---|---|---|---|
| 1,212,038 | 1/1917 | Flaxman | 273/81 R X |
| 1,983,756 | 12/1934 | Hessmert | 74/551.9 |
| 2,091,458 | 8/1937 | Sleight | 273/72 R |
| 2,808,996 | 10/1957 | Delfox | 85/8.3 X |
| 3,024,326 | 3/1962 | Wischhusen | 85/8.3 X |
| 3,170,691 | 2/1965 | Pritchard | 273/80.5 |
| 3,469,839 | 9/1969 | Pietronuto et al. | 273/72 R X |
| 3,697,069 | 10/1972 | Merola | 273/72 A |
| 3,779,551 | 12/1973 | Wilson | 273/72 A |
| 3,830,496 | 8/1974 | Reizer | 273/72 R |
| 3,927,466 | 12/1975 | Rosalsky | 273/72 A X |

FOREIGN PATENTS OR APPLICATIONS

| | | | |
|---|---|---|---|
| 1,473,295 | 2/1967 | France | 43/23 |
| 556,110 | 4/1923 | France | 273/81 R |
| 712,224 | 7/1954 | United Kingdom | 273/73 J |

OTHER PUBLICATIONS

"Voit" Catelog; July 1953, p. 22.

*Primary Examiner*—Richard J. Apley
*Attorney, Agent, or Firm*—Glenn, Palmer, Lyne & Gibbs

[57] ABSTRACT

A ball bat is provided and comprises a tubular metallic body having a hitting portion and a handle portion with the handle portion terminating in an outer end portion having a pair of aligned holes therein. The bat has a disc-like knob having spaced outer and inner end surfaces interconnected by an outwardly convex rounded edge portion with the knob having an opening extending therein from its inner surface toward its outer surface and having a pair of aligned holes therein. The outer end portion of the handle portion is disposed in the opening with the holes in the knob being disposed in aligned relation with the holes in the outer end portion and a pin extends through the holes in the outer end portion and the holes in the knob to hold the knob fixed to the handle portion.

2 Claims, 3 Drawing Figures

BALL BAT

BACKGROUND OF THE INVENTION

In recent years metal baseball and softball bats have been used in increasing numbers. These metal bats are provided with the usual knob at the end thereof to assist the batter in holding the bat and it is desirable that the knob be fixed to the metal bat body in a high strength manner with a minimum likelihood of becoming detached therefrom.

SUMMARY

Accordingly, it is a feature of this invention to provide an improved metal ball bat having a knob provided as a part thereof and which is easily fixed thereto in a high strength manner thereby assuring that the bat can be gripped and held by a batter with minimum likelihood that the bat will slide through the batter's hands in the process of swinging such bat.

Another feature of this invention is to provide a ball bat comprising a tubular metallic body having a hitting portion and a handle portion with the handle portion terminating in an outer end portion having a pair of aligned holes therein. The bat has a disc-like knob having spaced outer and inner surfaces interconnected by an outwardly convex rounded edge portion with the knob having an opening extending therein from the inner surface toward the outer surface and having a pair of aligned holes therein; and, the outer end portion of the handle portion is disposed in the opening with the holes in the knob being disposed in aligned relation with the holes in the outer end portion. The bat has a pin extending through the holes in the outer end portion and the holes in the knob to hold the knob fixed to the handle portion.

Accordingly, it is an object of this invention to provide an improved ball bat having one or more of the novel features set forth above or hereinafter shown or described.

Other details, features, objects, uses, and advantages of this invention will become apparent from the embodiment thereof presented in the following specification, claims, and drawing.

BRIEF DESCRIPTION OF THE DRAWING

The accompanying drawing shows present preferred embodiments of this invention, in which.

DESCRIPTION OF ILLUSTRATED EMBODIMENTS

Figure 1:
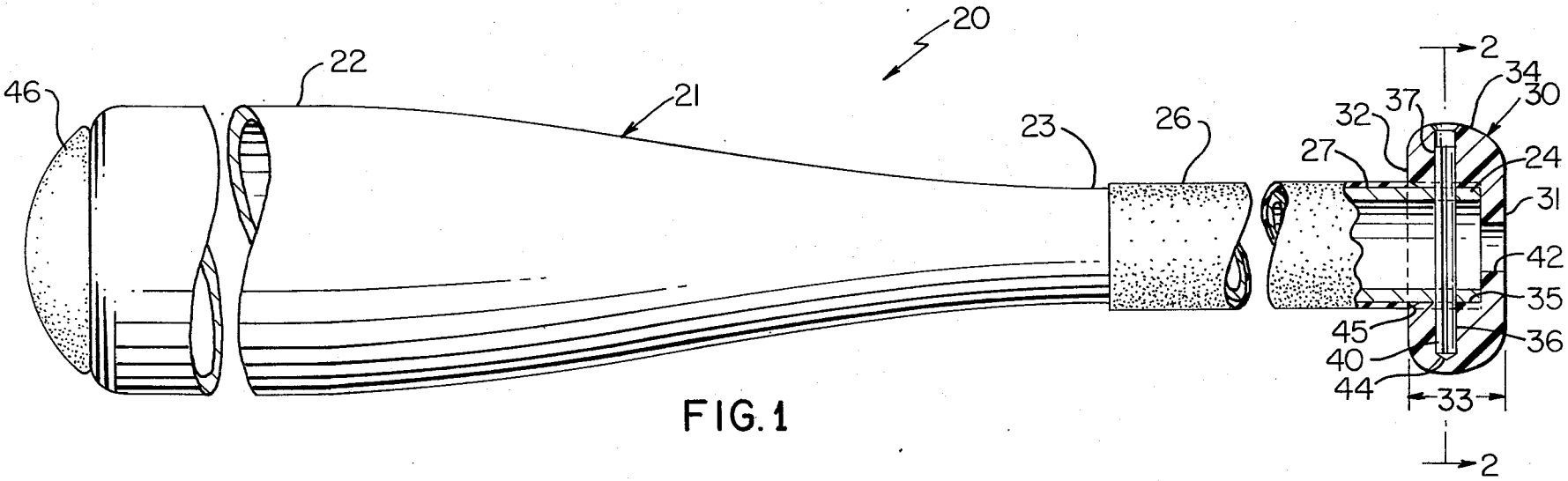
FIG. 1 is a view with parts in elevation, parts in cross section, and parts broken away illustrating one exemplary embodiment of the ball bat of this invention which has an improved knob fixed thereto in a high strength manner.

Reference is now made to FIG. 1 of the drawing which illustrates one exemplary embodiment of the ball bat of this invention which is designated generally by the reference numeral 20. The ball bat 20 comprises a tubular metallic body 21 having a hitting end portion

Figure 3:
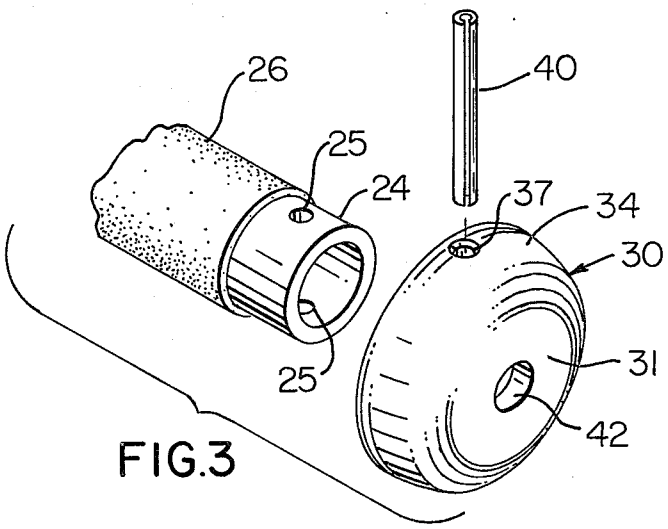
FIG. 3 is an exploded perspective view particularly illustrating an outer part of the handle portion of the bat of FIG. 1, the knob, and an expansion type pin utilized to hold such knob attached to the handle portion.

22 aand a handle end portion 23 with the handle end portion terminating in an outer end portion 24, also see FIG. 3, having a pair of aligned holes each designated by the reference numeral 25 provided therein. The bat 20 also has an elastomeric sleeve 26 attached to the handle portion utilizing any suitable technique known in the art and in this example, the elastomeric gripping sleeve is attached utilizing suitable adhesive means designated by the reference numeral 27.

The bat 20 has a disc-like knob 30 which has an outer end surface 31 and an inner end surface 32 which are arranged in spaced relation with the knob 30 having a particular thickness 33 therebetween. The knob 30 has an outwardly convex rounded edge portion 34 interconnecting the surfaces 31 and 32; and, the knob 30 also has an opening 35 extending therein from its inner surface 32 toward the outer surface 31 and the knob has a pair of aligned holes 36 and 37 provided therein.

As seen in FIG. 1, the outer end portion 24 of the handle portion 23 is disposed in the opening 35 with the holes 36 and 37 in the knob being disposed in aligned relation with the holes 25 in the outer end portion 24. A pin 40 extends through the holes 37, 25, 25, and 36 to hold the knob 30 fixed to the handle portion 23 in a high strength manner whereby a batter may grasp the elastomeric sleeve 26 and handle portion 23 and swing the bat in the usual manner; and, inasmuch as the knob is fixed directly to the tubular metal body of the handle portion 23, there is substantially no likelihood that the bat will escape from the batter by sliding through the batter's clenched hands.

Figure 2:
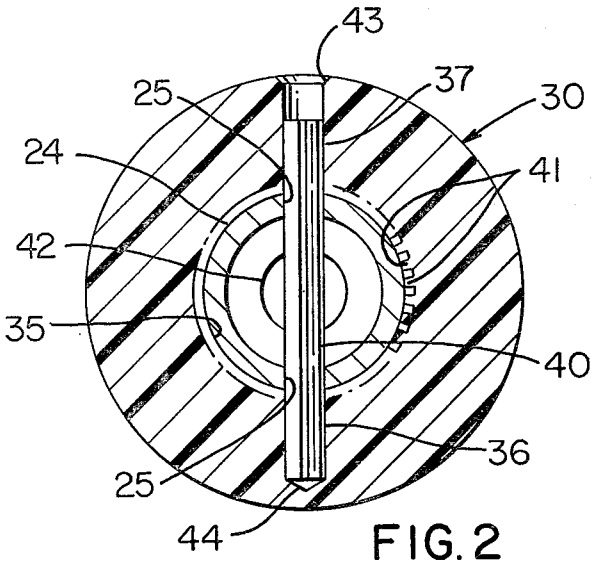
FIG. 2 is a view taken essentially on the line 2—2 of FIG. 1.

As it will be readily apparent from FIG. 2, the opening 35 is defined by serrations in the knob 30 with each serration being designated by the reference numeral 41; and, the serrations are substantially rectangular in cross-sectional outline. The knob is made of a suitable elastomeric material preferably in the form of an injection molded thermoplastic material such as high density polyethylene, or the like.

The serrations provide a reduced surface area which is engaged by the outside surface of end portion 24 due simply to the material that has been removed from the knob. Further, the thermoplastic material used to define the knob 30 also allows partial expansion of the knob and compression of the serrations to thereby enable the provision of an interference fit between the knob and the handle end portion 24 within the range of manufacturing tolerances of the knob and handle portion. Thus, this construction allows the knob to be press fit on the outer end portion 24 of the handle portion 23 within the range of manufacturing tolerances of the outside diameter of the end portion 24 and the range of manufacturing tolerances of the serrated opening 35.

As will be readily apparent from FIG. 3 of the drawing, the pin 40 is an expansion-type pin; and, it will be seen that the pin 40 of this example, is, in essence, a C-shaped pin which is compressed radially inwardly to enable insertion thereof through openings 37, 25, and 36 and once the pin is inserted or pressed in position, it expands and fixes the knob 30 to the end portion 24 in a high strength manner with minimum likelihood of removal. It will also be noted that the knob 30 has a cylindrical opening or bore 42 extending inwardly from its surface 31 and communicating with the opening 35 and the opening 42 facilitates inspection to assure that the pin 40 is in position.

The pin 40 may be made of any suitable material or may be any suitable type of expansion pin other than the C-shaped expansion pin shown; and, such pin may be made of material such as stainless steel, cadmium plated steel, and the like.

It will also be seen that the hole 37 extends from the outwardly convex rounded edge portion 34 and communicates with the opening 35 in the knob 30 with the hole 37 having a countersunk outer portion 43 therein to facilitate insertion of a tool for installation of the pin 40. The other hole 36 in the knob 30 is a blind hole whereby the hole 36 extends from the opening 35 and terminates in a closed end 44. Thus, once the C-shaped expansion pin 40 is forced into position to hold the knob 30 in position the blind hole 36 in essence assures that the pin 40 cannot be removed from the bat 20 by forcing such pin through its aligned holes.

It will also be seen that the elastomeric gripping sleeve 26 has an edge 45 thereof adjacent the inner surface 32 of the knob 30 with the knob 30 serving to hold the sleeve in position to prevent removal thereof even in the event of detachment of the sleeve due to loosening of the adhesive 27, or the like.

The bat 20 has been described as having a tubular metallic body and it will be appreciated that any suitable metallic material such as aluminous material, or the like, may be employed to define such tubular metallic body and in accordance with techniques known in the art. Further, the bat 20 may be provided with an end plug 46 in its hitting end portion 22 as shown or such bat may be closed by an integral metal portion or any other technique known in the art or the end may be open, if desired.

While present exemplary embodiments of this invention, and methods of practicing the same, have been illustrated and described, it will be recognized that this invention may be otherwise variously embodied and practiced within the scope of the following claims.

What is claimed is:

1. A ball bat comprising, a tubular metallic body having a hitting portion and a handle portion with said handle portion terminating in an outer end portion having a pair of aligned holes therein, a disc-like knob having spaced outer and inner end surfaces interconnected by an outwardly convex rounded edge portion, said knob having a handle portion receiving opening extending therein from said inner surface toward said outer surface and having a pair of aligned holes therein, said outer end portion of said handle portion being disposed in said opening with said holes in said knob being in aligned relation with said holes in said outer end portion, said knob being made of an elastomeric material, said knob having a particular thickness between its inner and outer surfaces and said handle portion receiving opening extending into said knob a distance less than said particular thickness and being defined by serrations in said knob which define the periphery of said opening and provide a surface area for engaging said outer end portion of said handle portion, one of said pair of said aligned holes in said knob extending from the outwardly convex rounded edge portion thereof and communicating with said opening therein and the other of said pair of aligned holes in said knob extending into said knob from said opening and forming a blind hole therein, and an expansion type pin extending through said holes in said outer end portion and said holes in said knob to hold said knob fixed to said handle portion by mechanical spring action of said pin; said elastomeric material of said knob allowing partial radial expansion thereof and compression of said serrations to provide an interference fit between said knob and handle portion.

2. A ball bat as set forth in claim 1 and further comprising an elastomeric sleeve attached to said handle portion and having an edge thereof adjacent said inner surface of said knob.

* * * * *